US011400717B2

(12) United States Patent
Yoneta

(10) Patent No.: US 11,400,717 B2
(45) Date of Patent: Aug. 2, 2022

(54) LIQUID DISCHARGE APPARATUS AND IMAGE FORMING METHOD

(71) Applicant: Ricoh Company, Ltd., Tokyo (JP)

(72) Inventor: Ryohta Yoneta, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 43 days.

(21) Appl. No.: 17/173,243

(22) Filed: Feb. 11, 2021

(65) Prior Publication Data

US 2021/0252857 A1 Aug. 19, 2021

(30) Foreign Application Priority Data

Feb. 18, 2020 (JP) ..... JP2020-025338

(51) Int. Cl.
*B41J 2/14* (2006.01)
*B41J 2/135* (2006.01)
*B41J 2/145* (2006.01)

(52) U.S. Cl.
CPC ..... *B41J 2/145* (2013.01); *B41J 2/1433* (2013.01)

(58) Field of Classification Search
CPC ..... B41J 2/135; B41J 2/145; B41J 2/1433
See application file for complete search history.

(56) References Cited

U.S. PATENT DOCUMENTS

2008/0143786 A1* 6/2008 Oikawa ..... B41J 2/2125 347/47
2013/0233948 A1 9/2013 Yoneta
2014/0071215 A1 3/2014 Yoneta
2014/0218450 A1 8/2014 Yoneta
2014/0253648 A1 9/2014 Yoneta
2015/0015646 A1 1/2015 Yoneta
2015/0077471 A1 3/2015 Yoneta
2018/0050544 A1* 2/2018 Suzuki ..... B41J 19/147
2018/0072066 A1 3/2018 Yoneta
2020/0164644 A1 5/2020 Yoneta et al.

FOREIGN PATENT DOCUMENTS

JP 5-261941 10/1993
JP 2000-190484 7/2000

* cited by examiner

*Primary Examiner* — Jason S Uhlenhake
(74) *Attorney, Agent, or Firm* — Xsensus LLP

(57) ABSTRACT

A liquid discharge apparatus includes a liquid container and a liquid discharge head. The liquid container is configured to contain liquid. The liquid discharge head is configured to discharge the liquid. The liquid discharge head includes a nozzle row in which a plurality of nozzles are aligned. The nozzle row includes a first region in which nozzles are aligned at a first nozzle pitch, a second region in which nozzles are aligned at a second nozzle pitch larger than the first nozzle pitch, and a third region in which nozzles are arranged at a third nozzle pitch smaller than the first nozzle pitch. A volume of the liquid discharged from the second region is larger than a volume of the liquid discharged from the first region. A volume of the liquid discharged from the third region is smaller than the volume of the liquid discharged from the first region.

9 Claims, 8 Drawing Sheets

LIQUID DISCHARGE APPARATUS AND IMAGE FORMING METHOD

CROSS-REFERENCE TO RELATED APPLICATION

This patent application is based on and claims priority pursuant to 35 U.S.C. § 119(a) to Japanese Patent Application No. 2020-025338, filed on Feb. 18, 2020, in the Japan Patent Office, the entire disclosure of which is hereby incorporated by reference herein.

BACKGROUND

Technical Field

Embodiments of the present disclosure relate to a liquid discharging apparatus and an image forming method.

Related Art

There is known a liquid discharge apparatus that includes a liquid discharge head to discharge liquid such as ink. For example, there is known a liquid discharge apparatus that includes a plurality of liquid discharge heads.

In such a configuration including a plurality of liquid discharge heads, when the plurality of liquid discharge heads are arranged in an array, misalignment is likely to occur at a portion at which the liquid discharge heads are joined, which may cause an uneven image. In order to prevent the unevenness of the image, for example, a technology has been proposed in which the pitches of recording elements of heads in an overlapping portion between the heads are slightly different from each other to the extent that the difference of the pitches cannot be visually distinguished from each other.

SUMMARY

In an aspect of the present disclosure, there is provided a liquid discharge apparatus includes a liquid container and a liquid discharge head. The liquid container is configured to contain liquid. The liquid discharge head is configured to discharge the liquid. The liquid discharge head includes a nozzle row in which a plurality of nozzles are aligned. The nozzle row includes a first region in which nozzles are aligned at a first nozzle pitch, a second region in which nozzles are aligned at a second nozzle pitch larger than the first nozzle pitch, and a third region in which nozzles are arranged at a third nozzle pitch smaller than the first nozzle pitch. A volume of the liquid discharged from the second region is larger than a volume of the liquid discharged from the first region. A volume of the liquid discharged from the third region is smaller than the volume of the liquid discharged from the first region.

In another aspect of the present disclosure, there is provided an image forming method that includes forming an image with a liquid discharge apparatus. The liquid discharge apparatus includes a liquid container to contain liquid and a liquid discharge head to discharge the liquid, the liquid discharge head including a nozzle row in which a plurality of nozzles are aligned, a plurality of individual liquid chambers communicated with the plurality of nozzles, and a plurality of actuators to pressurize the liquid in the plurality of individual liquid chambers, the nozzle row including a first region in which nozzles are aligned at a first nozzle pitch, a second region in which nozzles are aligned at a second nozzle pitch larger than the first nozzle pitch, and a third region in which nozzles are arranged at a third nozzle pitch smaller than the first nozzle pitch. In the liquid discharge apparatus, a volume of the liquid discharged from the second region is larger than a volume of the liquid discharged from the first region, and a volume of the liquid discharged from the third region is smaller than the volume of the liquid discharged from the first region.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

Figure 1:
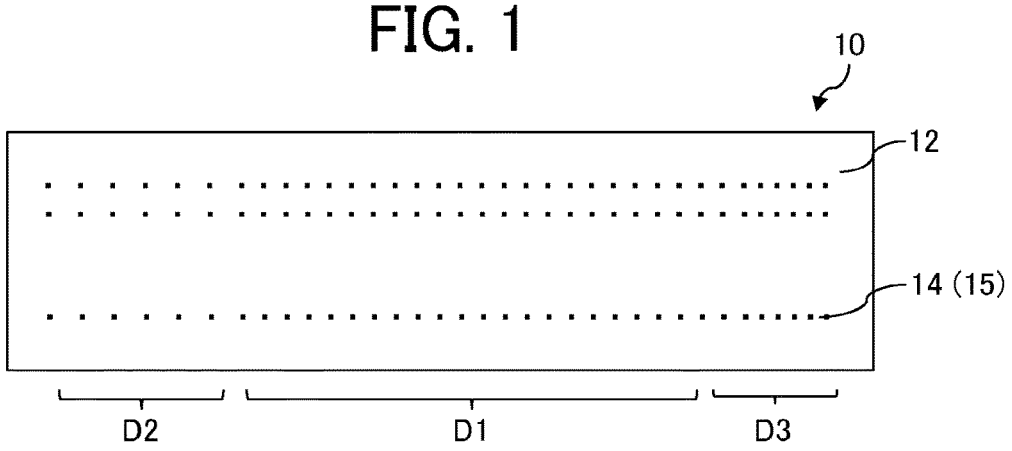
FIG. 1 is a schematic plan view illustrating nozzle rows in a liquid discharge head according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present disclosure. As used herein, the singular forms "a", "an" and "the" are intended to include the plural forms as well, unless the context clearly indicates otherwise.

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

With reference to drawings, descriptions are given below of embodiments of the present disclosure. It is to be noted that elements (for example, mechanical parts and components) having the same functions and shapes are denoted by the same reference numerals throughout the specification and redundant descriptions are omitted.

Hereinafter, a liquid discharging apparatus and an image forming method according to embodiments of the present disclosure are described with reference to drawings. Embodiments of the present disclosure are not limited to embodiments hereinafter described, and changes such as other embodiments, additions, modifications, and deletions may be made within the scope conceivable by those skilled in the art. Any aspects are included in the scope of the present disclosure as long as the actions and effects of the present disclosure are exhibited.

A liquid discharge apparatus according to an embodiment of the present disclosure includes a liquid container to contain liquid and a liquid discharge head to discharge the liquid. The liquid discharge head includes a nozzle row in which nozzles are aligned, a plurality of individual liquid chambers communicated with the nozzles, and a plurality of actuators to pressurize the liquid in the individual liquid chambers. The nozzle row includes a first region in which nozzles are aligned at a nozzle pitch D1, a second region in which nozzles are aligned at a nozzle pitch D2 larger than the nozzle pitch D1, and a third region in which nozzles are aligned at a nozzle pitch D3 smaller than the nozzle pitch D1. The volume of liquid discharged from the second region is larger than the volume of liquid discharged from the first region. The volume of liquid discharged from the third region is smaller than the volume of liquid discharged from the first region.

An image forming method according to an embodiment of the present disclosure includes a method of forming an image with a liquid discharge apparatus that includes a liquid container to contain liquid and a liquid discharge head to discharge the liquid. The liquid discharge head includes a nozzle row in which nozzles are aligned, a plurality of individual liquid chambers communicated with the nozzles, and a plurality of actuators to pressurize the liquid in the individual liquid chambers. The nozzle row includes a first region in which nozzles are aligned at a nozzle pitch D1, a second region in which nozzles are aligned at a nozzle pitch D2 larger than the nozzle pitch D1, and a third region in which nozzles are aligned at a nozzle pitch D3 smaller than the nozzle pitch D1. The liquid discharge apparatus sets the volume of liquid discharged from the second region to be larger than the volume of liquid discharged from the first region and sets the volume of liquid discharged from the third region to be smaller than the volume of liquid discharged from the first region.

According to the above-described embodiments, even when the alignment pitch of nozzles is different between regions, the occurrence of a difference in image density between the regions having different pitches can be reduced, thus allowing the unevenness of image to be reduced.

FIG. 1 is a diagram of a liquid discharge apparatus according to an embodiment of the present disclosure and is a schematic plan view illustrating nozzle rows in a liquid discharge head of the liquid discharge apparatus according to the present embodiment. A liquid discharge head 10 according to the present embodiment has nozzle rows 15 in each of which nozzles 14 are aligned on a nozzle surface 12. In the present embodiment, the number and arrangement of the nozzles 14 and the nozzle rows 15 are not limited to any particular number and arrangement and can be changed as appropriate.

In the present embodiment, the nozzle row 15 has a first region in which nozzles 14 are aligned at a nozzle pitch D1, a second region in which nozzles 14 are aligned at a nozzle pitch D2 larger than the nozzle pitch D1, and a third region in which nozzles 14 are aligned at a nozzle pitch D3 smaller than the nozzle pitch D1. As illustrated in FIG. 1, the sizes of the nozzle pitches satisfy a relation of D2>D1>D3. In FIG. 1, the first region is represented by D1, the second region is represented by D2, and the third region is represented by D3. The first region may be referred to as a normal pitch region.

In this embodiment, the interval between nozzles is described as a nozzle pitch. In addition, the interval between nozzles may be expressed as the interval between recording elements, and the nozzle pitch may be expressed as the pitch between recording elements.

In the present embodiment, the second region is disposed on one end side of a nozzle row 15, and the third region is disposed on the opposite end side of the nozzle row 15. The first region is disposed on the central side of the nozzle row 15. The number of nozzles included in each of the first region, the second region, and the third region can be appropriately changed.

Here, a comparative example is described. Conventionally, in a configuration in which the nozzle pitches are different from each other, a density difference occurs when the same droplets are discharged and landed. For example, the density is low in a region where the alignment pitch is large, and the density is high in a region where the alignment pitch is small. Accordingly, a density difference occurs in the obtained image, and unevenness of the image occurs. When a plurality of liquid discharge heads are used and regions having different nozzle pitches are adjacent to each other, a large density difference is visually recognized.

Figure 9A:
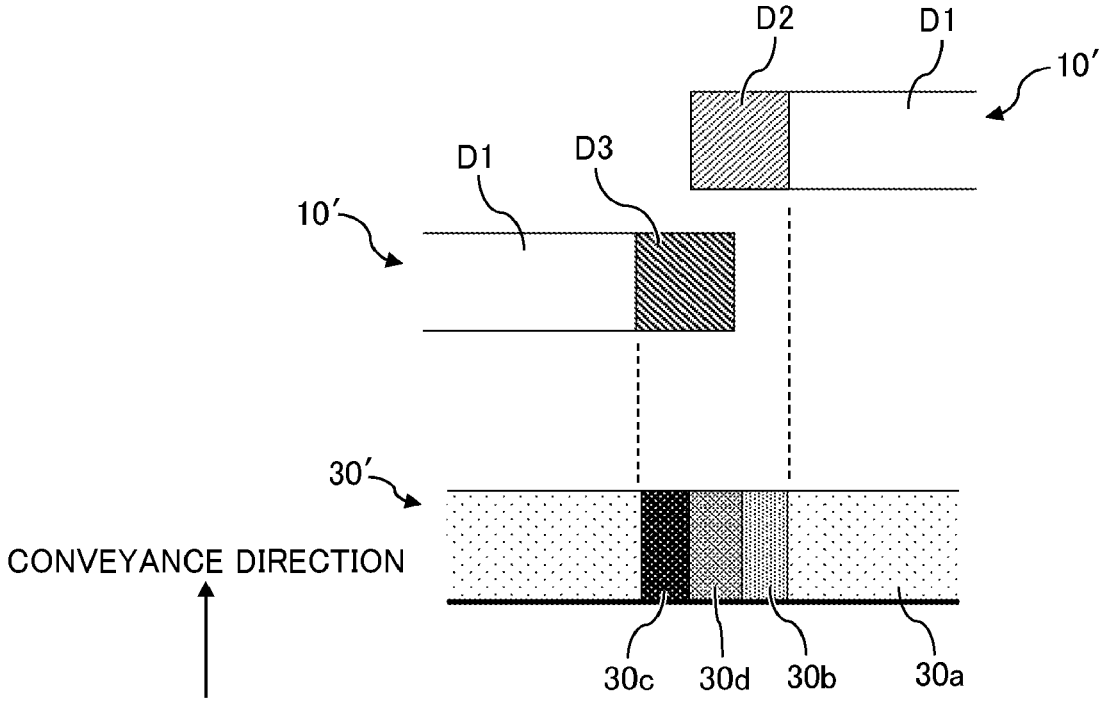
FIGS. 9A and 9B are schematic diagrams illustrating an arrangement example of liquid discharge heads and an obtained image, according to a comparative example.
Figure 9B:
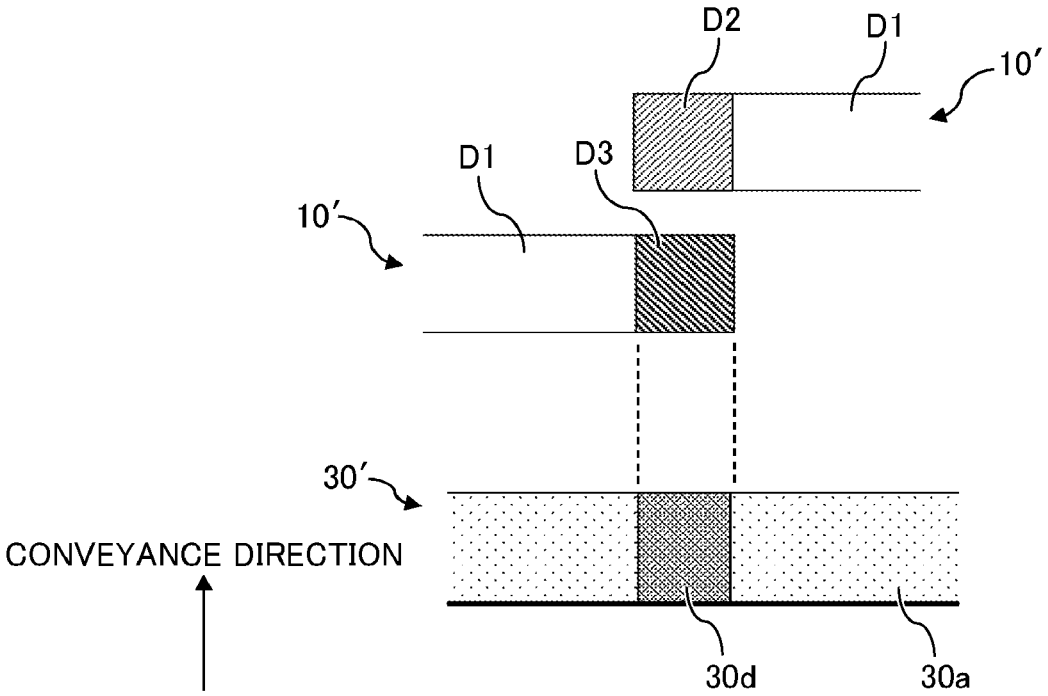

A comparative example is described with reference to FIGS. 9A and 9B. FIGS. 9A and 9B are diagrams schematically illustrating examples of a case in which liquid discharge heads 10' are arranged to form an image 30'. FIG. 9A illustrates an example in which the region of the nozzle pitch D2 and the region of the nozzle pitch D3 partially overlap each other in the direction perpendicular to the conveyance direction of a recording medium. FIG. 9B illustrates an example in which the region of the nozzle pitch D2 and the region of the nozzle pitch D3 entirely overlap each other.

In FIG. 9A, an image 30*a* corresponding to the normal pitch region, an image 30*b* corresponding to the region of the nozzle pitch D2, an image 30*c* corresponding to the region of the nozzle pitch D3, and an image 30*d* corresponding to a region in which the region of the nozzle pitch D2 and the region of the nozzle pitch D3 overlap are illustrated. As illustrated in FIG. 9A, in the comparative example, the density is different between the image 30*a* and each of the images 30*b* to 30*d*, and image unevenness occurs.

Further, in FIG. 9B, the image 30*d* corresponding to the region in which the region of the nozzle pitch D2 and the region of the nozzle pitch D3 overlap each other has a density different from the density of the image 30*a*, and image unevenness occurs. As described above, in the comparative example, a difference in density occurs in one liquid discharge head. Accordingly, when a plurality of liquid discharge heads are used, image unevenness is more noticeable.

The density is low in a region in which the nozzle pitch is large, and the density is high in a region in which the nozzle pitch is small. Therefore, in order to deal with the above-described disadvantage, it is preferable to discharge larger droplets in a region in which the nozzle pitch is large, and to discharge smaller droplets in a region in which the nozzle pitch is small. In the present embodiment, the volume of liquid discharged in the second region is set to be larger than the volume of liquid discharged in the first region. The volume of liquid discharged in the third region is set to be smaller than the volume of liquid discharged in the first region. Such a configuration can restrain occurrence of a density difference between regions having different nozzle pitches in one nozzle row. Thus, unevenness of image density can be restrained, and a high quality image can be obtained.

The method of making the volume of the liquid discharged in the second region and the volume of the liquid discharged in the third region different from each other as described above can be appropriately changed. For example, the following method may be used. Hereinafter, the discharged liquid is also referred to as droplet.

As one method, in a configuration having an individual liquid chamber communicating with each nozzle, the volume of the individual liquid chamber may be different according to the size of the nozzle pitch. In such a case, the volume of the individual liquid chamber in the second region is set larger than the volume of the individual liquid chamber in the first region. The volume of the individual liquid chamber in the third region is set smaller than the volume of the individual liquid chamber in the first region. Accordingly, the volume of the discharged liquid can be adjusted as described above.

Figure 2:
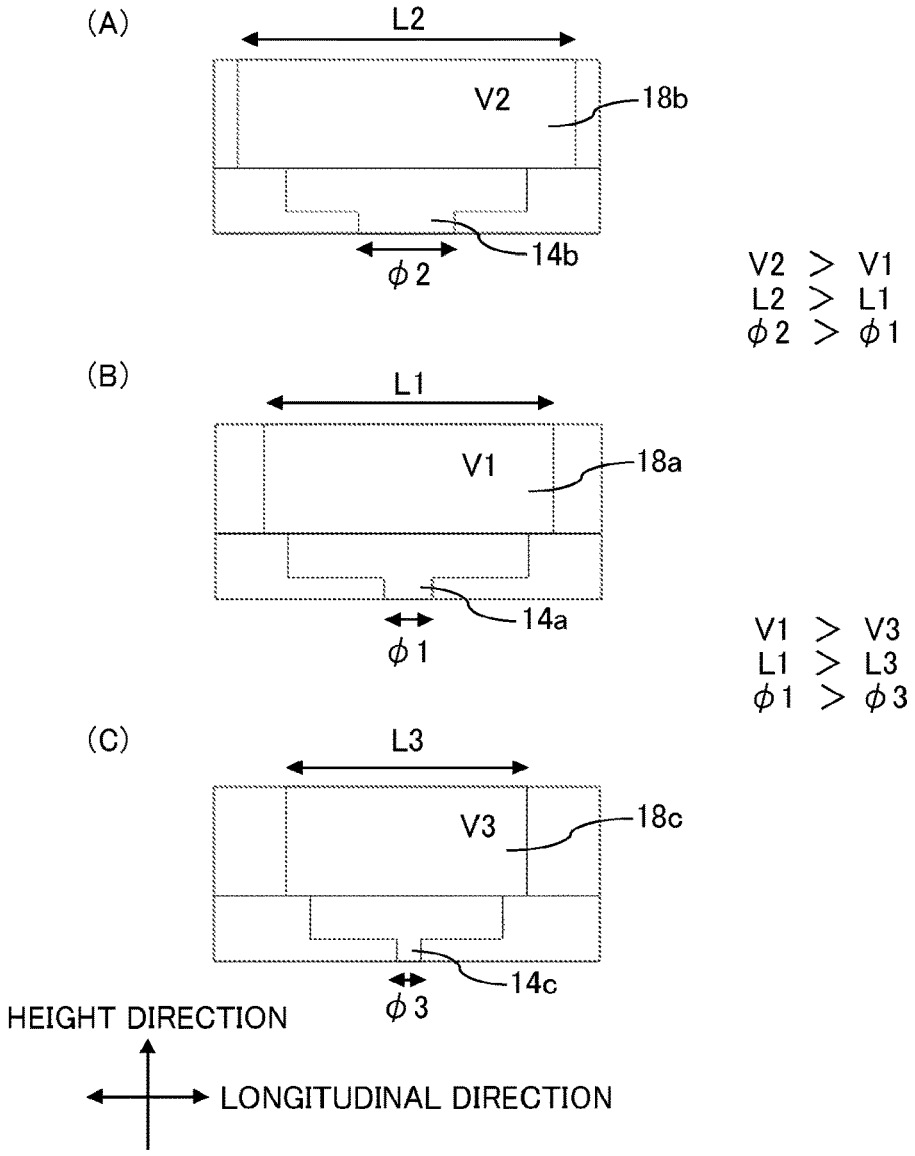
FIG. 2 is a diagram schematically illustrating cross sections of individual liquid chambers according to an embodiment of the present disclosure, taken along a nozzle alignment direction.

An example of the above-described method is described with reference to drawings. FIG. 2 includes parts (A), (B), and (C) that are schematic cross-sectional views of an example of individual liquid chambers. FIG. 2 is a diagram schematically illustrating cross sections along the nozzle alignment direction, and the nozzle alignment direction is the longitudinal direction of the individual liquid chamber 18.

Parts (A) to (C) of FIG. 2 illustrate individual liquid chambers in the second region, the first region, and the third region, respectively. Focusing on parts (A) and (B) of FIG. 2, the volume V2 of an individual liquid chamber 18*b* in the second region is larger than the volume V1 of an individual liquid chamber 18*a* in the first region. Similarly, focusing on parts (B) and (C) of FIG. 2, the volume V3 of an individual liquid chamber 18*c* in the third region is smaller than the volume V1 of the individual liquid chamber 18*a* in the first region.

With such a configuration, as described above, the volume of droplet can be set to be larger in the region (second region) in which the nozzle pitch is large, and conversely, the volume of droplet can be set to be smaller in the region (third region) in which the nozzle pitch is small.

The method of adjusting the volume of the individual liquid chamber can be appropriately changed as follows, for example. When the length of the individual liquid chamber is defined as a length in the alignment direction of nozzles, the length of the individual liquid chamber in the second region is set to be larger than the length of the individual liquid chamber in the first region. The length of the individual liquid chamber in the third region is smaller than the length of the individual liquid chamber in the first region. Such a configuration is also illustrated in FIG. 2. The length L2 of the individual liquid chamber 18*b* in the second region is larger than the length L1 of the individual liquid chamber 18*a* in the first region. The length L3 of the individual liquid chamber 18*c* in the third region is smaller than the length L1 of the individual liquid chamber 18*a* in the first region.

In addition to the above-described configuration, for example, the width of the individual liquid chamber in the second region may be larger than the width of the individual liquid chamber in the first region, and the width of the individual liquid chamber in the third region may be smaller than the width of the individual liquid chamber in the first region, where the width of the individual liquid chamber is defined as a width in the direction perpendicular to the alignment direction of nozzles.

Figure 3:
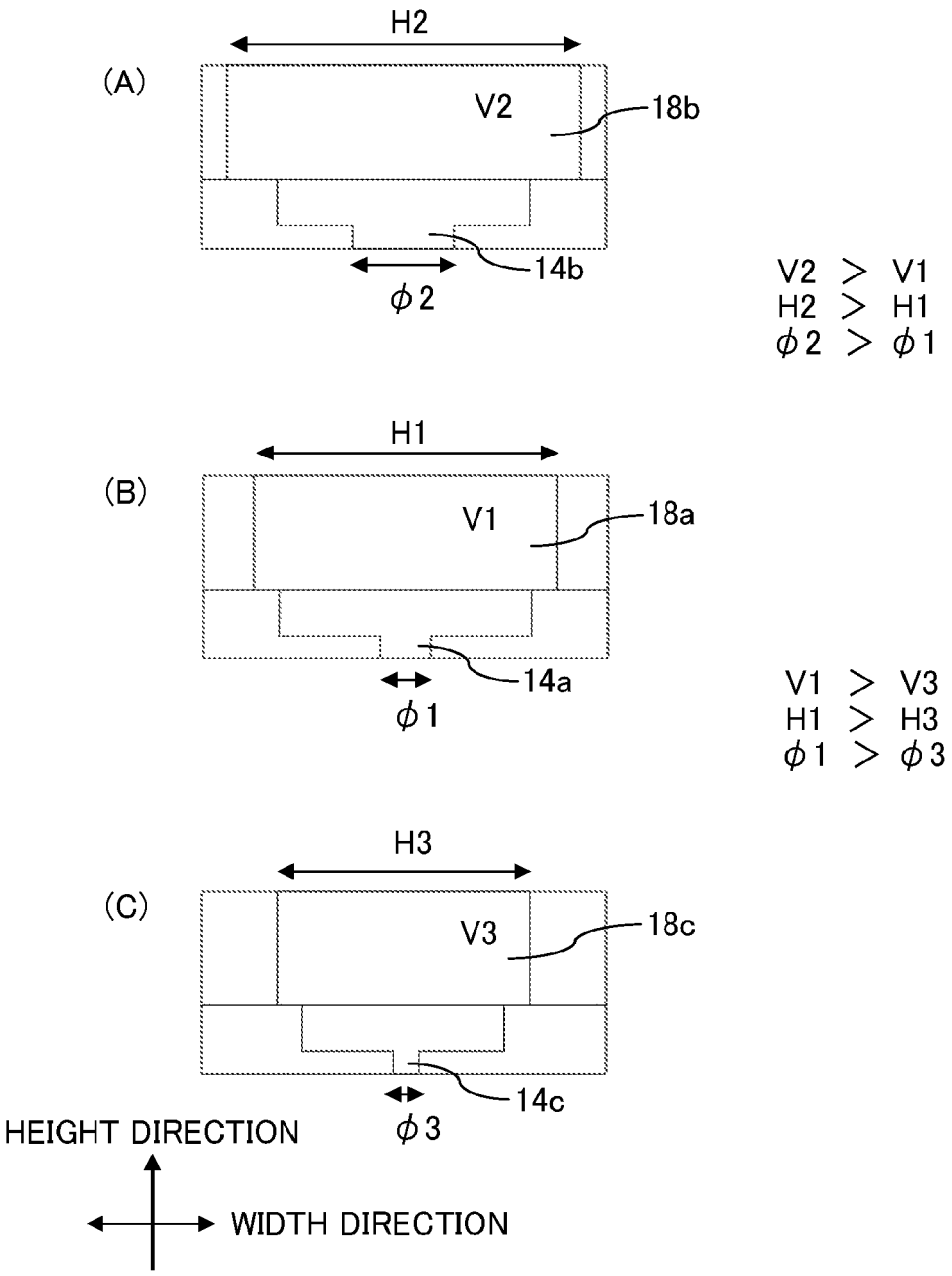
FIG. 3 is a diagram schematically illustrating cross sections of individual liquid chambers according to an embodiment of the present disclosure, taken along a direction perpendicular to a nozzle alignment direction.

Such a relation is illustrated in FIG. 3. FIG. 3 is a diagram schematically illustrating cross sections along a direction perpendicular to the nozzle alignment direction, and the direction perpendicular to the nozzle alignment direction is the width direction of the individual liquid chamber. As illustrated in FIG. 3, the width H2 of the individual liquid chamber 18*b* in the second region is larger than the width H1 of the individual liquid chamber 18*a* in the first region, and the width H3 of the individual liquid chamber 18*c* in the third region is smaller than the width H1 of the individual liquid chamber 18*a* in the first region. Accordingly, the volume V2 of the individual liquid chamber 18*b* of the second region can be set to be larger than the volume V1 of the individual liquid chamber 18*a* of the first region, and the volume V3 of the individual liquid chamber 18*c* of the third region can be set to be smaller than the volume V1 of the individual liquid chamber 18*a* of the first region.

Figure 4:
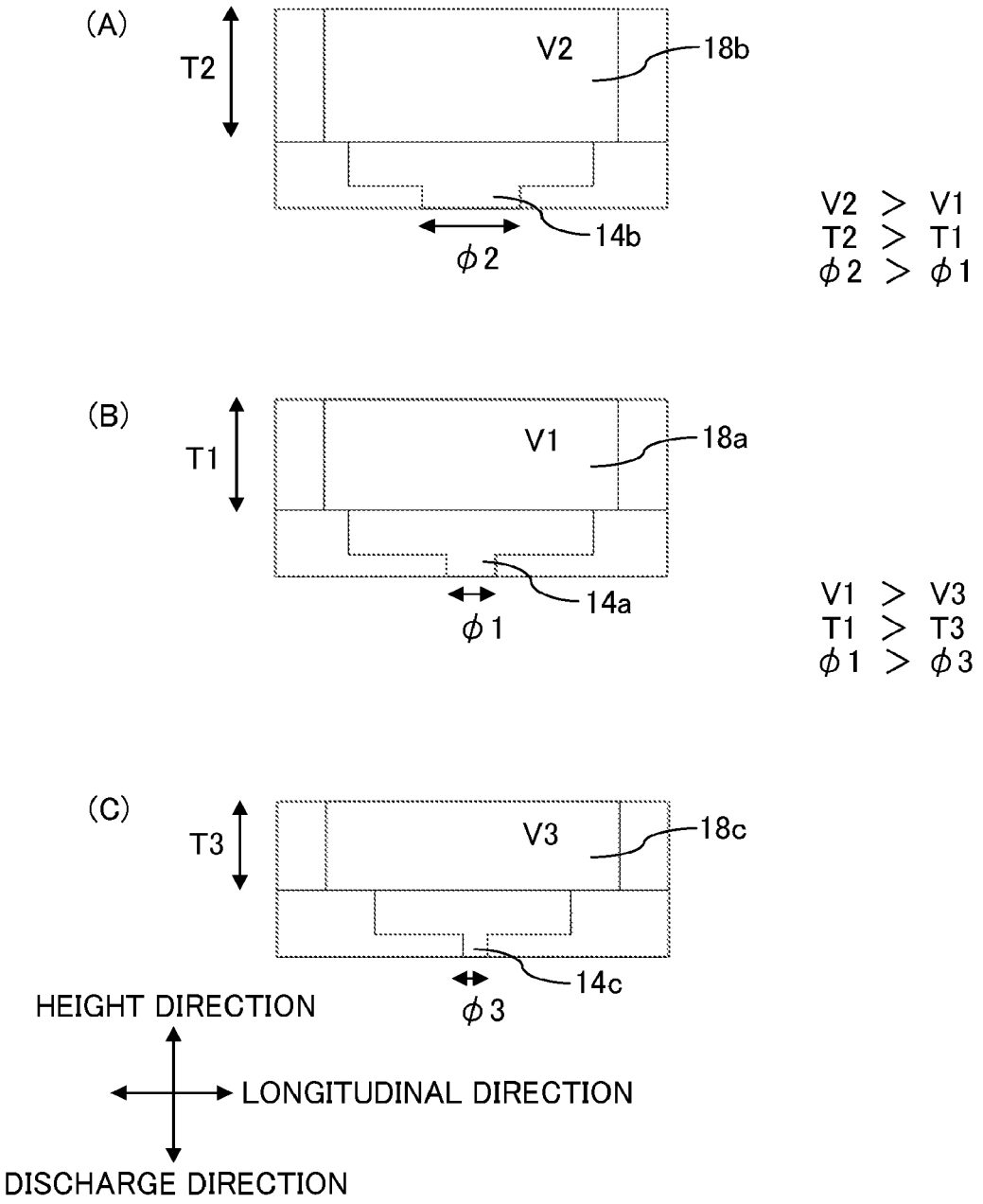
FIG. 4 is a diagram schematically illustrating cross sections of individual liquid chambers according to an embodiment of the present disclosure, taken along a nozzle alignment direction.

In the examples illustrated in FIGS. 2 and 4, the length and the width of the individual liquid chamber are illustrated to be approximately the same size. However, the sizes of the length and the width of the individual liquid chamber is not limited to the above-described sizes, and the length and the width of the individual liquid chamber may be the same size or may be different sizes.

In addition to the above, when the height of the individual liquid chamber is defined as the height in the direction in which liquid is discharged, the height of the individual liquid chamber in the second region may be greater than the height of the individual liquid chamber in the first region, and the height of the individual liquid chamber in the third region may be smaller than the height of the individual liquid chamber in the first region.

Such a relation is illustrated in FIG. 4. FIG. 4 is a diagram schematically illustrating cross sections along the nozzle alignment direction, similarly with FIG. 2, and the alignment direction of nozzles is the longitudinal direction of the individual liquid chamber. As illustrated in FIG. 4, the height T2 of the individual liquid chamber 18*b* in the second region is larger than the height T1 of the individual liquid chamber 18*a* in the first region, and the height T3 of the individual liquid chamber 18*c* in the third region is smaller than the height T1 of the individual liquid chamber 18*a* in the first region. Accordingly, the volume V2 of the individual liquid chamber 18*b* of the second region can be set to be larger than the volume V1 of the individual liquid chamber 18*a* of the first region, and the volume V3 of the individual liquid chamber 18*c* of the third region can be set to be smaller than the volume V1 of the individual liquid chamber 18*a* of the first region.

In addition to the above, for example, the nozzle diameter may be changed according to the size of the nozzle pitch. In such a case, the nozzle diameter of the second region is set larger than the nozzle diameter of the first region, and the nozzle diameter of the third region is set smaller than the nozzle diameter of the first region. Accordingly, the volume of the discharged liquid can be adjusted as described above.

For example, as illustrated in FIG. 2, the nozzle diameter φ2 of the second region is set larger than the nozzle diameter φ1 of the first region, and the nozzle diameter φ3 of the third region is set smaller than the nozzle diameter φ1 of the first region.

In the present embodiment, it is particularly preferable that the nozzle diameter and the volume of the individual liquid chamber vary according to the size of the nozzle pitch. It is preferable that the nozzle diameter of the second region and the volume of the individual liquid chamber are larger than the nozzle diameter of the first region and the volume of the individual liquid chamber, respectively, and the nozzle diameter of the third region and the volume of the individual liquid chamber are smaller than the nozzle diameter of the first region and the volume of the individual liquid chamber, respectively.

The effect of changing the nozzle diameter and the volume of the individual liquid chamber is described. As the nozzle diameter is increased, the volume of the discharged droplet increases, and the resonance period Tc specific to the individual liquid chamber decreases. As the volume of the individual liquid chamber is increased, the volume of the discharged droplet increases, and the resonance period Tc specific to the individual liquid chamber increases. When both the nozzle diameter and the volume of the individual liquid chamber are increased, the volume of the liquid droplet increases, but the influence on the resonance period Tc is cancelled out. Accordingly, the resonance period Tc is substantially equal to the resonance period Tc in the normal pitch region. Thus, even when the same waveform as in the normal pitch region is applied, only the volume of droplet can be increased.

On the other hand, as the nozzle diameter is decreased, the volume of droplet decreases, and the resonance period Tc specific to the individual liquid chamber increases. As the volume of the individual liquid chamber is reduced, the volume of the discharged droplet decreases, and the resonance period Tc specific to the individual liquid chamber decreases. When both the nozzle diameter and the volume of the individual liquid chamber are decreased, the volume of the liquid droplet decreases, but the influence on the resonance period Tc is cancelled out. Accordingly, the resonance period Tc is substantially equal to the resonance period Tc in the normal pitch region. Thus, even when the same waveform as in the normal pitch region is applied, only the volume of droplet can be decreased.

Focusing on parts (A) and (B) of FIG. 2, the nozzle size φ2 in the second region and the volume V2 of the individual liquid chamber 18*b* are larger than the nozzle size φ1 in the second region and the volume V1 of the individual liquid chamber 18*a*, respectively. Similarly, seeing parts (B) and (C) of FIG. 2, the nozzle size φ3 of the third region and the volume V3 of the individual liquid chamber 18*c* are smaller than the nozzle size φ1 of the first region and the volume V1 of the individual liquid chamber 18*a*.

With such a configuration, as described above, the volume of droplet can be set to be larger in the region (second region) in which the nozzle pitch is large, and conversely, the volume of droplet can be set to be smaller in the region (third region) in which the nozzle pitch is small. Furthermore, even when the same waveform as in the normal pitch region is applied, the volume of droplet can be set larger in the second region, and the volume of the droplet can be smaller in the third region.

With the liquid discharge head according to the above-described embodiment, even when the alignment pitch of nozzles is different between regions, the occurrence of a difference in image density between the regions having different pitches can be reduced, thus allowing image unevenness to be reduced. In the liquid discharge apparatus according to the present embodiment, the number and arrangement of liquid discharge heads are not particularly limited and can be appropriately changed. The configuration of the liquid container that contains liquid may be changed as appropriate as long as the liquid container can contain liquid.

Figure 5:
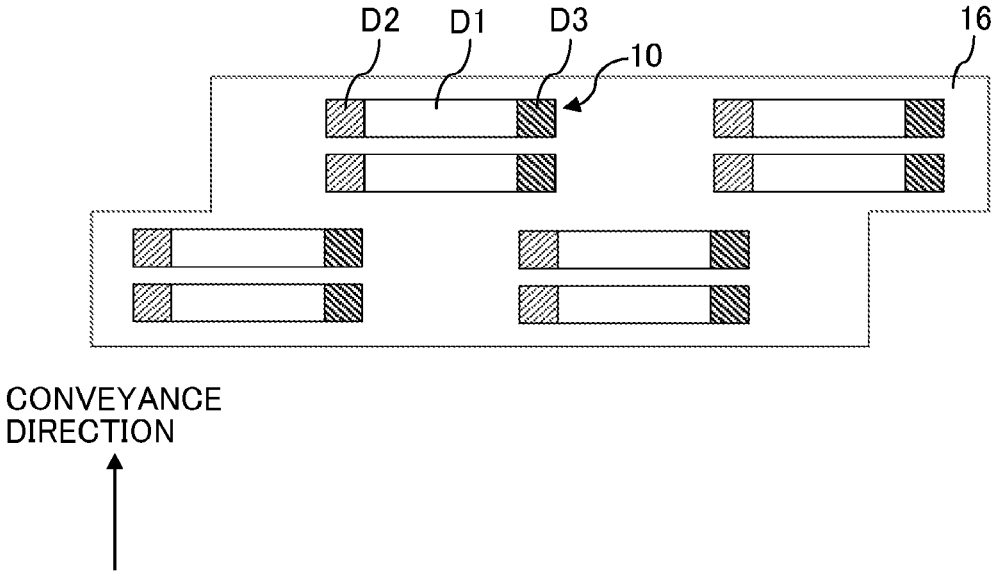
FIG. 5 is a schematic plan view illustrating an arrangement example of liquid discharge heads in a liquid discharge apparatus according to an embodiment of the present disclosure.

FIG. 5 is a schematic plan view illustrating an arrangement example of liquid discharge heads in the liquid discharge apparatus according to the present embodiment. In the example illustrated in FIG. 5, a plurality of liquid discharge heads 10 are held on a base 16 serving as a holding member. In FIG. 5, the term "conveyance direction" indicates the conveyance direction of a recording medium, and may be, for example, a direction perpendicular to the nozzle alignment direction.

In the present embodiment, each of the liquid discharge heads 10 has a longitudinal direction and a short direction. The plurality of liquid discharge heads 10 partially overlap each other in the short direction in a second region (D2 in FIG. 5) and a third region (D3 in FIG. 5). According to the present embodiment, in a configuration including a plurality of liquid discharge heads, a liquid discharge apparatus can reduce image unevenness.

Figure 6A:
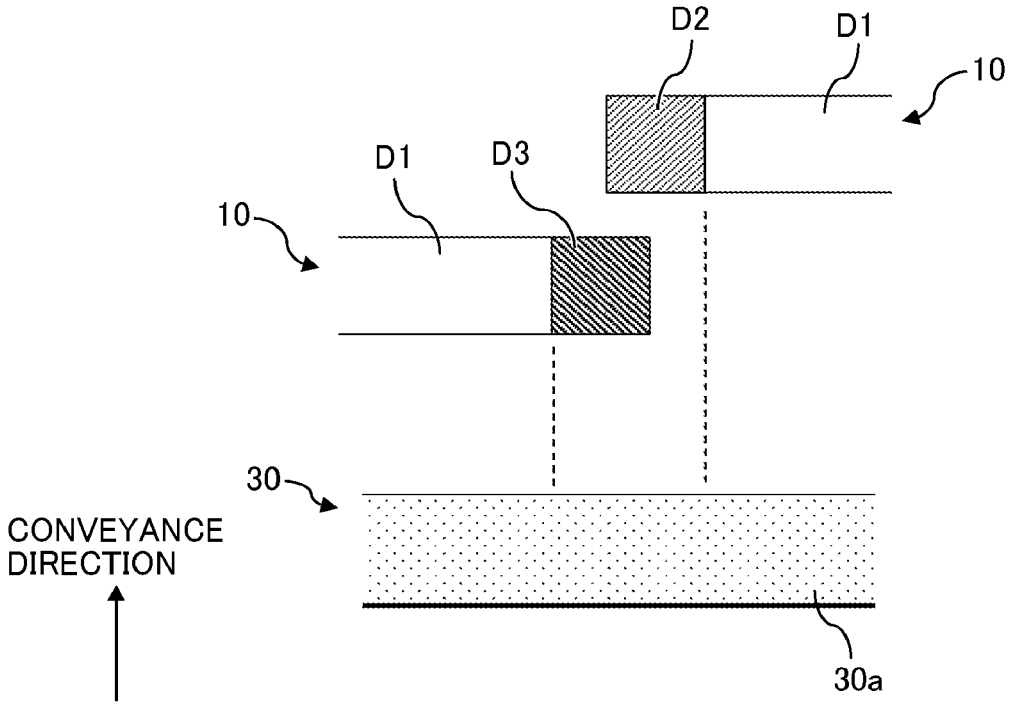
FIGS. 6A and 6B are schematic diagrams illustrating an arrangement example of liquid discharge heads and an obtained image, according to an embodiment of the present disclosure.
Figure 6B:
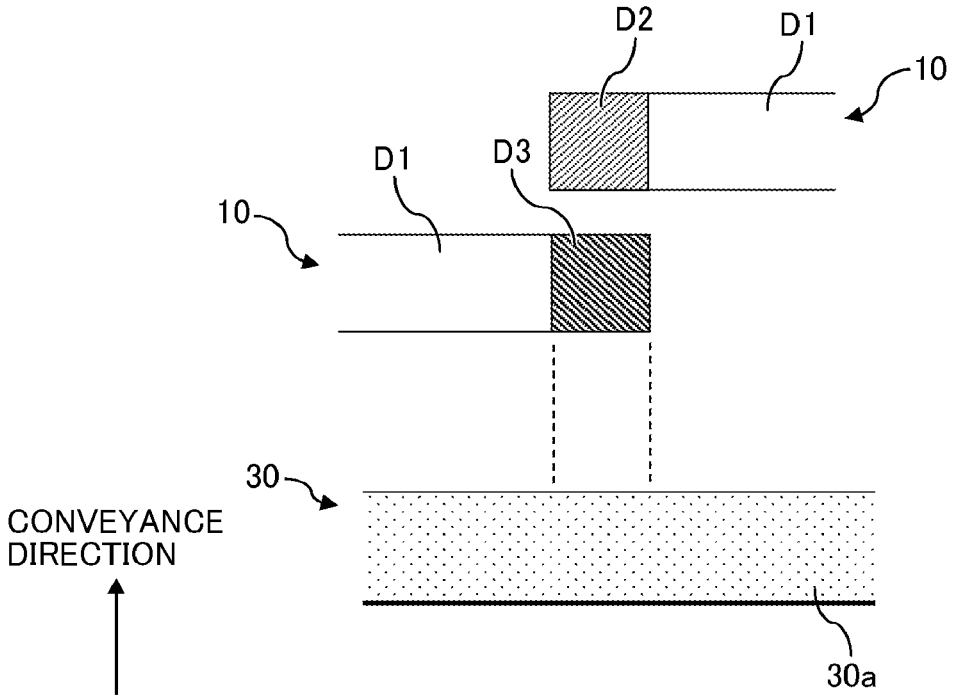

FIGS. 6A and 6B are diagrams schematically illustrating an example of image formation in a case in which a plurality of liquid discharge heads are used. FIGS. 6A and 6B are diagrams each schematically illustrating an example in which an image 30 is formed by liquid discharge heads 10 arranged side by side. FIG. 6A illustrates an example in which the region of the nozzle pitch D2 and the region of the nozzle pitch D3 partially overlap each other in the direction perpendicular to the conveyance direction of a recording medium. FIG. 6B illustrates an example in which the region of the nozzle pitch D2 and the region of the nozzle pitch D3 entirely overlap each other.

According to the liquid discharging apparatus according to the present embodiment, the occurrence of a density difference between regions having different pitches can be reduced. Accordingly, as illustrated in FIGS. 6A and 6B, the density difference can be reduced in the regions of the nozzle pitches D1 to D3. Thus, image unevenness can be reduced and a good image can be obtained.

Figure 7:
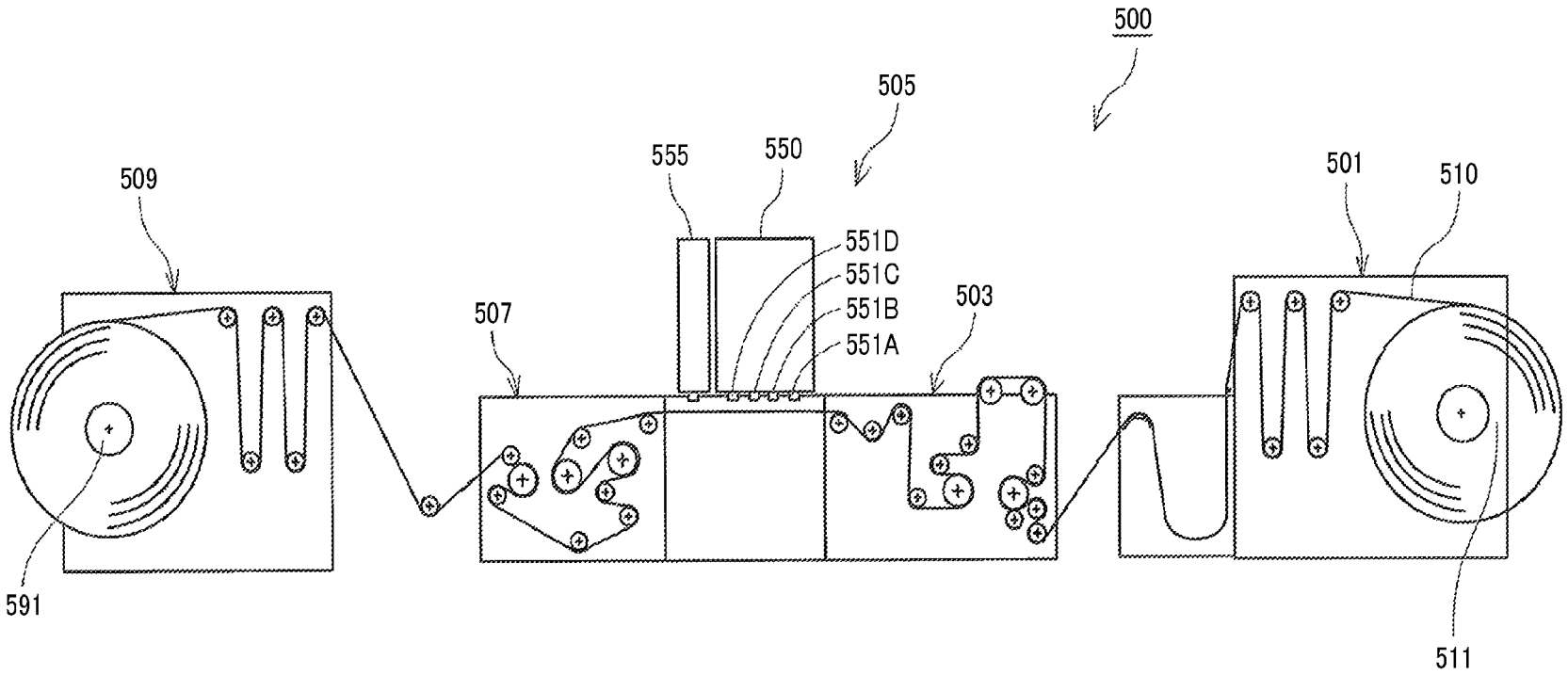
FIG. 7 is a schematic view of a liquid discharge apparatus according to an embodiment of the present invention.
Figure 8:
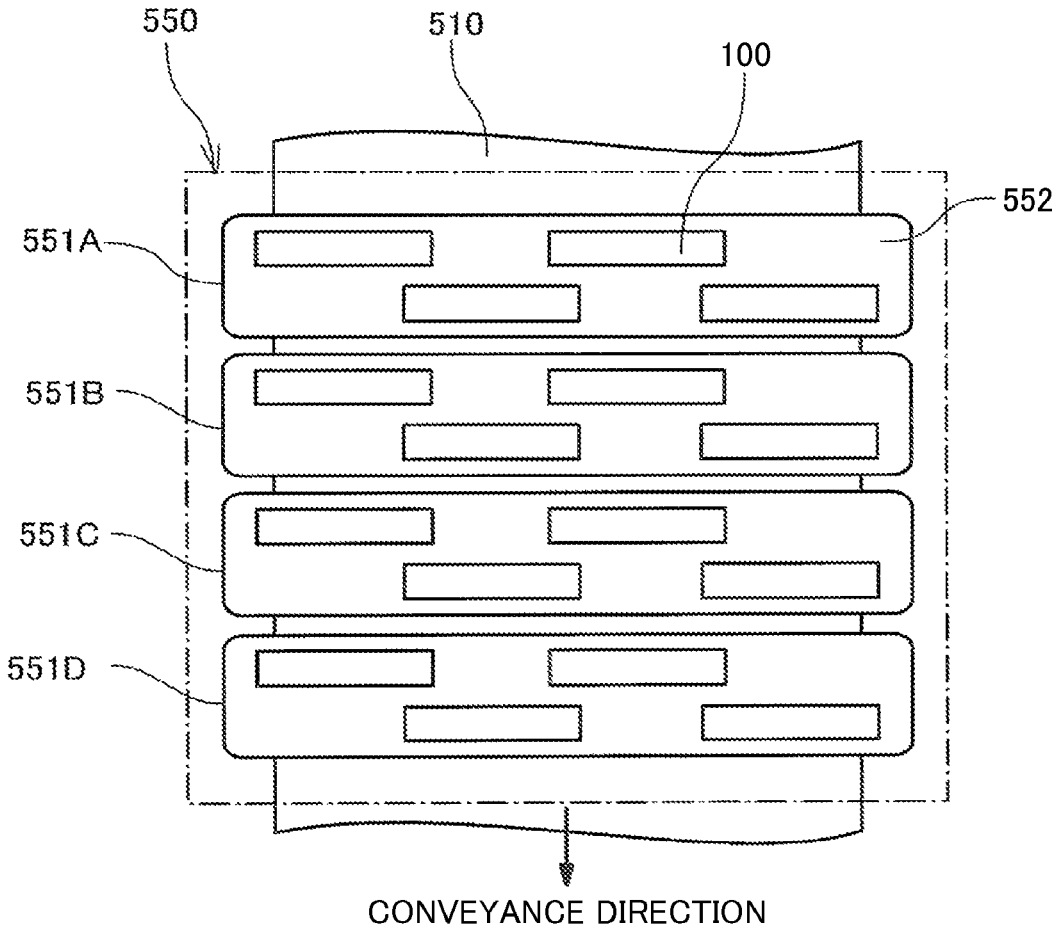
FIG. 8 is a schematic view of a head unit of the liquid discharge apparatus, according to an embodiment of the present disclosure.

Next, a liquid discharge apparatus according to another embodiment of the present disclosure is described with reference to FIGS. 7 and 8. FIG. 7 is a schematic view of a liquid discharge apparatus according to another embodiment of the present disclosure. FIG. 8 is a plan view of a head unit of the liquid discharge apparatus according to an embodiment of the present disclosure. Here, as the head unit, a head unit is described that includes the liquid discharge head according to the above-described embodiment.

A printing apparatus 500 serving as the liquid discharge apparatus according to the present embodiment includes, e.g., a feeder 501, a guide conveyor 503, a printer 505, a drier 507, and a carrier 509. The feeder 501 feeds a continuous medium (or a web) 510 inward. The guide conveyor 503 guides and conveys the continuous medium 510 such as a continuous sheet of paper or a sheet medium fed inward from the feeder 501. The printer 505 performs printing by discharging liquid onto the conveyed continuous medium 510 to form an image. The drier 507 dries the continuous medium 510 with the image formed. The carrier 509 feeds the dried continuous medium 510 outward.

The continuous medium 510 is sent out from an original winding roller 511 of the feeder 501, is guided and conveyed by rollers of the feeder 501, the guide conveyor 503, the drier 507, and the carrier 509, and is wound up by a wind-up roller 591 of the carrier 509.

In the printer 505, the continuous medium 510 is conveyed on a conveyance guide 559 so as to face a head unit 550 and a head unit 555. An image is formed with the liquid discharged from the head unit 550, and post-processing is performed with the processing liquid discharged from the head unit 555.

In the head unit 550, for example, full-line head arrays 551A, 551B, 551C, and 551D for four colors (hereinafter referred to as the "head arrays 551" unless the colors distinguished) are arranged in this order from the upstream side in a direction of conveyance of the continuous medium 510.

The head arrays 551A, 551B, 551C, and 551D are liquid dischargers to discharge liquids of, for example, black (K), cyan (C), magenta (M), and yellow (Y), respectively, onto the continuous medium 510 being conveyed. Note that the type and number of colors are not limited to the above-described example.

The liquid discharge apparatus according to the present embodiment preferably has a configuration of circulating a refrigerant. The refrigerant is circulated with, for example, a circulation mechanism. Thus, the temperature between head members can be efficiently made constant.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

Any one of the above-described operations may be performed in various other ways, for example, in an order different from the one described above.

The invention claimed is:

1. A liquid discharge apparatus, comprising:

a liquid container configured to contain liquid; and a liquid discharge head configured to discharge the liquid, the liquid discharge head including a nozzle row in which a plurality of nozzles are aligned, the nozzle row including:

a first region in which nozzles are aligned at a first nozzle pitch;

a second region in which nozzles are aligned at a second nozzle pitch larger than the first nozzle pitch; and a third region in which nozzles are arranged at a third nozzle pitch smaller than the first nozzle pitch, a volume of the liquid discharged from the second region being larger than a volume of the liquid discharged from the first region, a volume of the liquid discharged from the third region being smaller than the volume of the liquid discharged from the first region.

2. The liquid discharge apparatus according to claim 1, further comprising a plurality of individual liquid chambers communicating with the plurality of nozzles, respectively, wherein a second volume of a second individual liquid chamber in the second region is larger than a first volume of a first individual liquid chamber in the first region, and a third volume of a third individual liquid chamber in the third region is smaller than the first volume of the first individual liquid chamber in the first region.

3. The liquid discharge apparatus according to claim 2, wherein a second length of the second individual liquid chamber in the second region is larger than a first length of the first individual liquid chamber in the first region, and a third length of the third individual liquid chamber in the third region is smaller than the first length of the first individual liquid chamber in the first region, where each of the first length, the second length, and the third length is a length in a direction in which the nozzles are aligned.

4. The liquid discharge apparatus according to claim 2, wherein a second width of the second individual liquid chamber in the second region is larger than a first width of the first individual liquid chamber in the first region, and a third width of the third individual liquid chamber in the third region is smaller than the first width of the first individual liquid chamber in the first region, where each of the first width, the second width, and the third width is a width in a direction perpendicular to a direction in which the nozzles are aligned.

5. The liquid discharge apparatus according to claim 2, wherein a second height of the second individual liquid chamber in the second region is larger than a first height of the first individual liquid chamber in the first region, and a third height of the third individual liquid chamber in the third region is smaller than the first height of the first individual liquid chamber in the first region, where each of the first height, the second height, and the third height is a height in a direction in which the liquid is discharged.

6. The liquid discharge apparatus according to claim 1, wherein a nozzle diameter of the second region is larger than a nozzle diameter of the first region, and a nozzle diameter of the third region is smaller than the nozzle diameter of the first region.

7. The liquid discharge apparatus according to claim 1, further comprising a plurality of individual liquid chambers communicating with the plurality of nozzles, respectively, wherein a second nozzle diameter of the nozzles in the second region is larger than a first nozzle diameter of the nozzles in the first region, and a third nozzle diameter of the nozzles in the third region is smaller than the first nozzle diameter of the nozzles in the first region, wherein a second volume of a second individual liquid chamber in the second region is larger than a first volume of a first individual liquid chamber in the first region, and a third volume of a third individual liquid chamber in the third region is smaller than the first volume of the first individual liquid chamber in the first region.

8. The liquid discharge apparatus according to claim 1, further comprising a plurality of liquid discharge heads, including the liquid discharge head, wherein each of the plurality of liquid discharge heads has a longitudinal direction and a short direction, wherein the plurality of liquid discharge heads partially overlap in the short direction in the second region and the third region.

9. An image forming method, comprising forming an image with a liquid discharge apparatus that includes a liquid container to contain liquid and a liquid discharge head to discharge the liquid, the liquid discharge head including a nozzle row in which a plurality of nozzles are aligned, a plurality of individual liquid chambers communicated with the plurality of nozzles, and a plurality of actuators to pressurize the liquid in the plurality of individual liquid chambers, the nozzle row including a first region in which nozzles are aligned at a first nozzle pitch, a second region in which nozzles are aligned at a second nozzle pitch larger than the first nozzle pitch, and a third region in which nozzles are arranged at a third nozzle pitch smaller than the first nozzle pitch, wherein, in the liquid discharge apparatus, a volume of the liquid discharged from the second region is larger than a volume of the liquid discharged from the first region, and a volume of the liquid discharged from the third region is smaller than the volume of the liquid discharged from the first region.

* * * * *